United States Patent [19]

Means

[11] Patent Number: 4,674,196

[45] Date of Patent: Jun. 23, 1987

[54] CONDENSED STEAM AGITATOR FOR A DRYER CYLINDER AND METHOD

[75] Inventor: John A. Means, Charlotte, N.C.

[73] Assignee: KMW Corporation, Charlotte, N.C.

[21] Appl. No.: 803,124

[22] Filed: Nov. 29, 1985

[51] Int. Cl.[4] ..... F26B 3/20

[52] U.S. Cl. ..... 34/41; 34/119; 34/125

[58] Field of Search ..... 34/41, 119, 124, 125

[56] References Cited

U.S. PATENT DOCUMENTS

| | | |
|---|---|---|
| 733,718 | 7/1903 | Hildebrand . |
| 3,217,426 | 11/1965 | Barnscheidt et al. . |
| 3,724,094 | 4/1973 | Appel et al. . |
| 3,808,700 | 5/1974 | Kraus . |
| 4,195,417 | 4/1980 | Mathews . |
| 4,251,927 | 2/1981 | Luthi . |
| 4,542,593 | 9/1985 | Viitanen et al. . |

FOREIGN PATENT DOCUMENTS

| | | | |
|---|---|---|---|
| 686887 | 5/1964 | Canada | 34/125 |
| 1066887 | 11/1979 | Canada . | |
| 861642 | 1/1953 | Fed. Rep. of Germany | 34/124 |
| 2032058 | 4/1980 | United Kingdom . | |

*Primary Examiner*—Larry I. Schwartz
*Assistant Examiner*—David W. Westphal
*Attorney, Agent, or Firm*—Bell, Seltzer, Park & Gibson

[57] ABSTRACT

A condensate agitator is provided for use in paper machine dryer cylinders. The agitator comprises a generally cylindrical open-work body which overlies portions of the interior surface of the dryer cylinder with its outer surface lying in flush engagement therewith. A modular agitator construction is also disclosed for facilitating installation of the agitator in a dryer cylinder without requiring the use of fasteners in accordance with a method for that installation which is also disclosed.

15 Claims, 8 Drawing Figures

CONDENSED STEAM AGITATOR FOR A DRYER CYLINDER AND METHOD

BACKGROUND OF THE INVENTION

This invention relates to a condensed steam agitator for use in paper machine dryer cylinders and to a related method for installing a particular preferred form of the agitator in the dryer cylinders. The use of the invention, as particularly described hereinbelow, overcomes the many and various shortcomings associated with conventional means for reducing the substantial limitations on dryer efficiency presented by the condition known as condensed steam rimming.

In the papermaking field, an aqueous suspension of cellulose fibers or pulp furnish is typically passed through a moving wire as on a Fourdrinier machine, for example, where the rapid drainage of the water through the interstices in the wire forms the paper web. Thereafter the formed paper web may be passed through a press section whereupon it is typically conveyed through the dryer section of the paper machine where the moisture content in the sheet is reduced to its final levels. The dryer section typically utilizes a plurality of steam-heated dryer cylinders each of which is equipped with a steam inlet for introducing live steam into the interior of the cylinder and a syphon for removing accumulated condensate from the interior of the dryer.

At relatively low operating speeds, the syphon adequately performs its function of condensate removal. At the prevailing operating speeds of above approximately 1,000 feet per minute, however, the condensed steam tends to form a layer along the interior surface of the cylinder. This phenomenon, which is termed condensate rimming, impedes the heat transfer efficiency of the dryers since the layer acts as an effective insulator. And, since the industry is highly capital intensive, the limitations placed on dryer capacity by condensate rimming is highly significant both from the standpoint of product quality and production rates.

In order to reduce the detrimental effects of the rimming phenomenon, the use of a plurality of rails or spoiler bars to disrupt the condensate layer and thereby improve heat transfer through the dryer shell was proposed by Barnscheidt et al in U.S. Pat. No. 3,217,426. U.S. Pat. No. 3,724,094 to Appel et al disclosed a relationship between the optimum spacing of the spoiler bars on the one hand and the diameter of the respective dryer and depth of the condensate layer on the other. The use of spoiler bars presents its own set of limitations, however, including extended installation periods which require upwards of 10 man-hours per dryer primarily as a result of the need for careful spacing of the spoiler bars relative to each other. Moreover, spoiler bars are installed based on the estimated or average operational conditions for the dryers which obviously vary on a particular machine as production rates change and different paper grades or basis weights are formed on the same machine. Consequently, an otherwise effective arrangement at the time of installation can be rendered ineffectual almost immediately after installation by routine changes in operating conditions. And, while U.S. Pat. No. 4,195,417 to Mathews advocates the use of magnetic bars and suggests that the relative spacing of the bars may be changed in response to changing operational conditions, this is virtually impossible in practice where around the clock operation is the norm rather than the exception. In order to reposition the bars, a paper machine would have to be shut down for a sufficient time to allow the dryers to cool to room temperature since physical entry to accomplish the adjustment is otherwise impossible. Those familiar with prevailing realities in the papermaking industry immediately recognize the impracticality of undertaking such a procedure each time the operating conditions of the paper machine are altered. Notwithstanding the substantial limitations associated with the use of spoiler bars, they remain the predominant form of agitator employed in the industry as indicated for example, by the recent issuance of U.S. Pat. No. 4,542,593 to Vittanen et al for a spoiler bar arrangement utilizing an arrangement of attachment bands.

The Vittanen et al patent as well as Matthews recognize a further problem with the use of spoiler bars, namely that the use of fasteners which penetrate the dryer wall weakens the dryer shell. Although penetration of the dryer wall is avoided by Matthews' magnetic bars, these magnetic bars are very expensive, are susceptible to corrosion, and as a whole are sensitive to high temperatures such as those found in dryer cylinders.

A departure from the still prevalent concept of spoiler bars is disclosed in published United Kingdom Patent Application 2,032,058 (1980), naming Guntram Feurstein as the originator. The Feurstein published application discloses the use of a wire mesh network or a network formed of "bent strips" for agitating the condensed steam in a dryer, which network is spaced away along much of its length from the inner surface of the drying cylinder to promote flows both over and under the network. As a result, the condensate layer must reach a minimum depth, dependent on the degree of spacing, before any effective agitation is accomplished. In addition, the Feurstein network is attached by fastener screws to the inner surface of the dryer at various points with the attendant shortcomings, i.e. a weakening of the shell, as described above.

SUMMARY OF THE INVENTION

The shortcomings associated with known condensed steam agitators are overcome by the present construction for a dryer cylinder which includes a condensate agitator comprising a generally cylindrical body having a plurality of spaced apart openings therein to provide an open-work body. The body overlies portions of the interior surface of the dryer with its outer surface lying in flush engagement therewith. Since the material surrounding the openings is in flush engagement with the interior surface of the dryer, the agitator induces positive movements and agitation in the condensed steam layer notwithstanding multiple variations in the paper machine operating conditions. In addition, the uniformity of the structure promotes uniformity in the cross machine moisture profile of the formed paper web. The agitator may be mounted in the dryer by utilizing the modular spring loaded device described below or through the use of spring-loaded expanding rings.

The modular agitator construction described below facilitates the installation of an agitator, in accordance with a novel method which is also disclosed herein. Each of the modular agitation elements used in conjunction with the method includes an open-work member and resilient connecting means extending in offset relation from the opposing ends of the open-work member. The modular elements are arranged within the cylinder dryer in a plurality of side by side circular rows. The resilient connecting means serve to maintain the modular agitation elements in spring biased interengagement with each other without requiring the use of independent fasteners. In contrast to prior agitator constructions utilizing spoiler bars, for example, the modular agitator construction described herein facilitates their installation in approximately four manhours. The substantial savings in installation costs alone, particularly with respect to the corresponding reductions in paper machine down time required to accomplish such an installation, represents a significant and highly desirable advance in a critical area of the papermaking process.

IN THE DRAWINGS

Additional features and attendant advantages of the invention will be described in detail hereinbelow in connection with the drawings in which.

Figure 8:
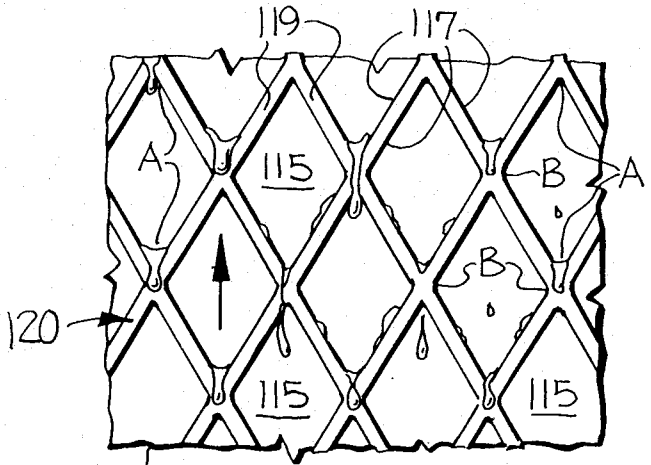
Figure 7:
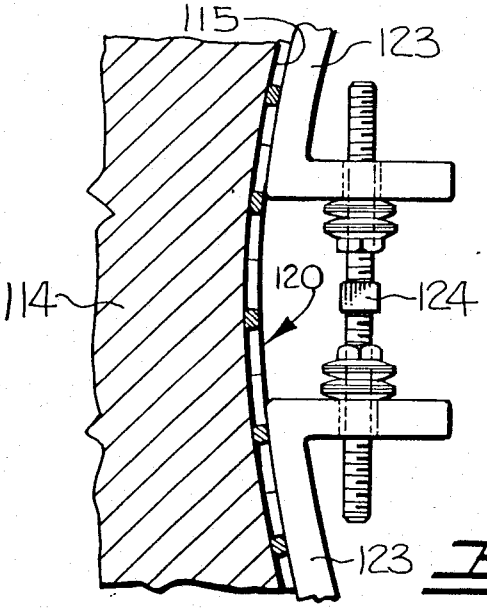

FIG. 7 is a partial side elevation view in cross section through the dryer cylinder wall and depicting a spring-loaded threaded member for use in adjusting the expanding rings; and FIG. 8 is a front perspective view of a portion of a condensed steam agitator made in accordance with the invention and depicting the flow of condensate along and over the material surrounding the openings in the agitator.

DETAILED DESCRIPTION

Figure 1:
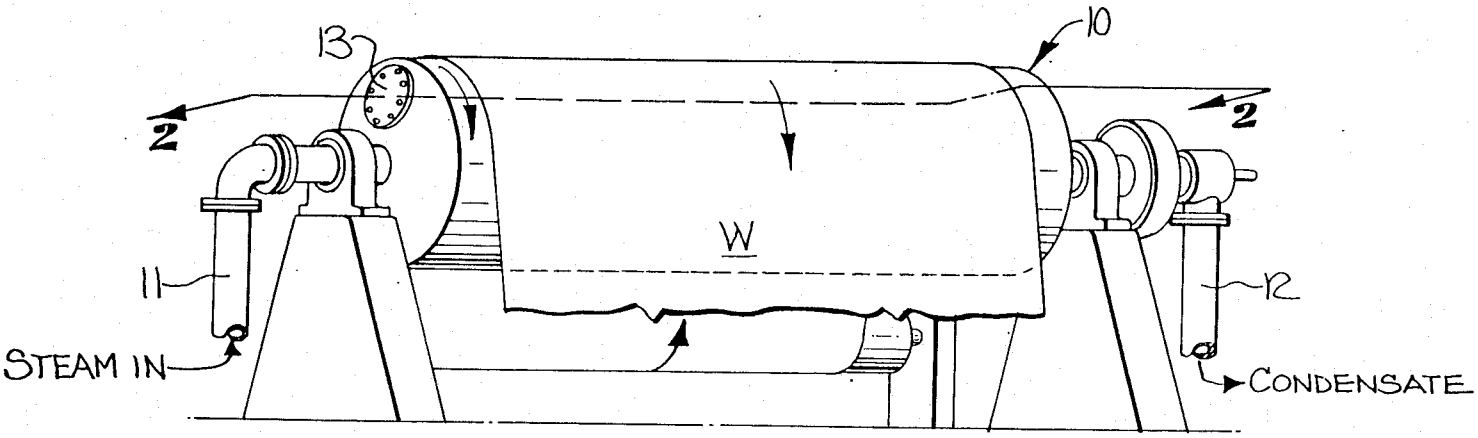
FIG. 1 is a perspective view of a dryer cylinder equipped with a condensed steam agitator made in accordance with the invention.

As is well-known in the papermaking field, a paper web W is formed at the wet end of a paper machine and is typically transferred to a press section where moisture is removed by mechanical means. Thereafter, the web is conveyed by one or more felts (not shown) through the drying section of the machine in serpentine fashion whereupon additional moisture is removed by evaporation. In the drying section, the felts bring the web into contact with the exterior surfaces of a plurality of dryer cylinders 10. A typical dryer cylinder 10 is depicted in FIG. 1 and includes a steam inlet 11 for introducing live steam (typically at 75–125 p.s.i.g. and 320°–350° F.) into the interior of the dryer and condensate removal means 12. A manhole 13 is also provided so that ingress to the interior of the dryer may be accomplished for maintenance purposes or for installation of an agitator as described below. The heat provided by the steam is transferred, primarily by conduction, through the cylinder wall 14 (FIG. 2) to the web W so as to evaporate a portion of the moisture present in the web. As heat is transferred to the web, the steam condenses and the resulting condensate is in turn removed by the condensate removal means 12 which typically includes at least one syphon 12A, which is preferably of the rotary type as depicted. The inlet to the syphon 12A is spaced away from the interior surface of the dryer cylinder, and typically at a distance of approximately 1/16th of an inch. At lower operating speeds the condensate collects in a pool at the bottom of the dryer cylinder. As noted above, however, the condensate forms a layer about the entire interior surface 15 of the dryer at higher operating speeds.

Figure 2:
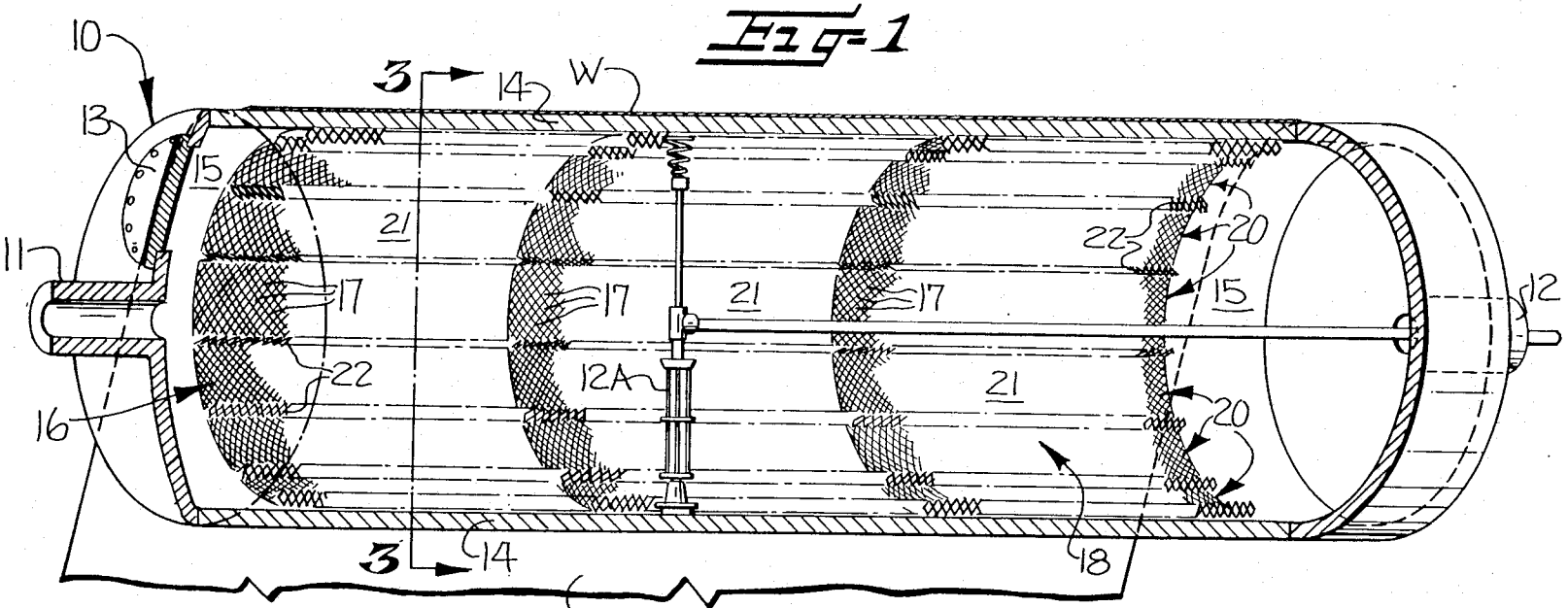
FIG. 2 is a perspective view of the dryer cylinder shown in FIG. 1 and having portions cutaway along the line 2—2 therein to expose a portion of the interior of the cylinder dryer.
Figure 5:
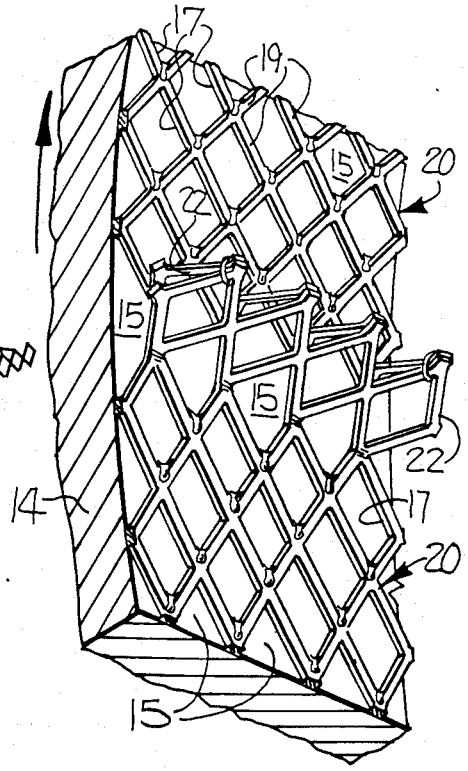
FIG. 5 is a sectional perspective view of the dryer cylinder wall and depicting the abutting relation between resilient connecting means on adjacent modular agitation elements.

In order to interrupt or agitate the condensed steam layer to improve the amount of heat transferred through the dryer wall 14, condensate agitation means 16 are provided (FIG. 2). The condensate agitation means 16 is comprised of a generally cylindrical body having spaced apart openings 17 (FIG. 5) throughout the body so as to form an open-work body 18. The open-work body 18 overlies portions of the interior surface 15 of the dryer cylinder 10 and preferably with its outer surface in flush engagement therewith. Accordingly, the material 19 surrounding the openings 17 will be in virtually or substantially continuous contact with the interior surface 15 of the dryer cylinder.

Figure 6:
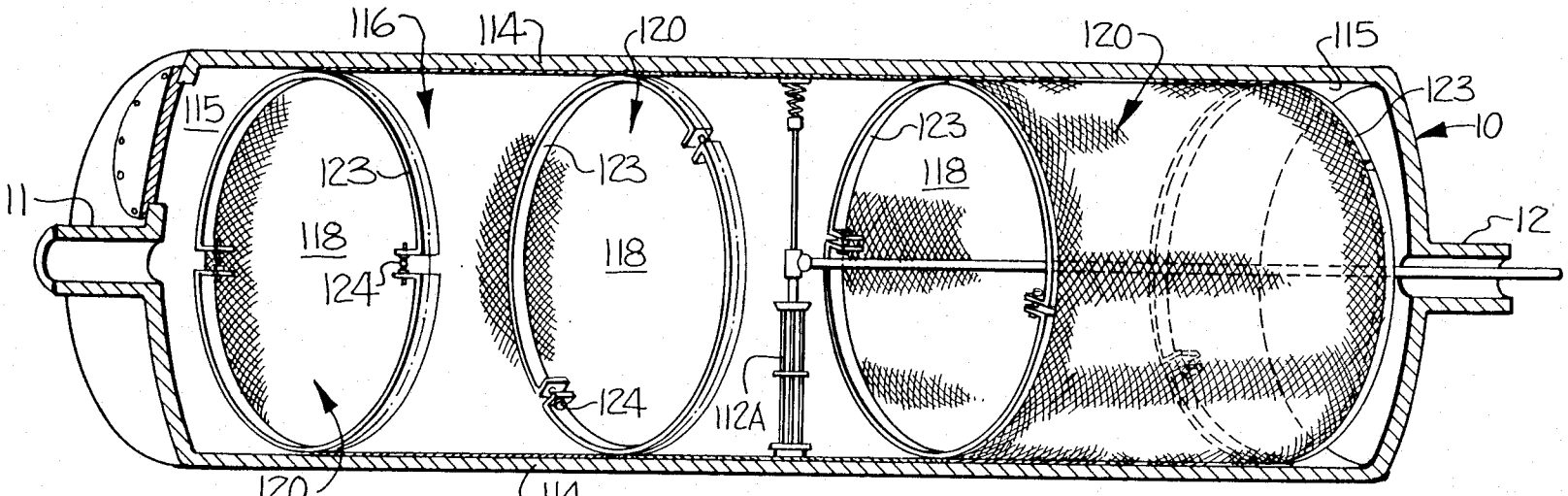
FIG. 6 is a perspective view of a dryer cylinder having portions cutaway to expose an alternative embodiment of the condensed steam agitator including a plurality of expanding rings for maintaining the outer-surface of the agitator in flush engagement with the interior surface of the dryer cylinder.

The cylindrical body 18 may be formed from a plurality of modular elements 20 (FIG. 4) or may alternatively be constructed of substantially unitary, annular open-work segments 120 to provide the body 118 as depicted in FIG. 6. As shown in FIG. 6, which depicts three annular segments 120, these segments and in turn the body 118 are held in position on the interior surface 115 of the dryer cylinder by four spring-loaded expanding rings 123 (see FIG. 7). The expanding rings 123 are adjusted by the use of spring-loaded threaded adjustment means 124, the spring-loading serving to protect against loosening of the agitator as a result of thermal expansion or subsequent contraction. The spring-loading may be accomplished by any of several known means including through the use of cooperating spring washers as depicted in FIG. 7. The expanding rings 123 are preferably positioned at the points of abutment between adjacent annular segments (shown in broken line form, FIG. 6). This form of construction is suitable for use in new cylinder dryer constructions where they may be installed prior to the application of the cylinder heads. In existing facilities, the modular elements 20 (FIG. 4) are preferred, and particularly when the installation is made in accordance with the method described hereinbelow.

Figure 3:
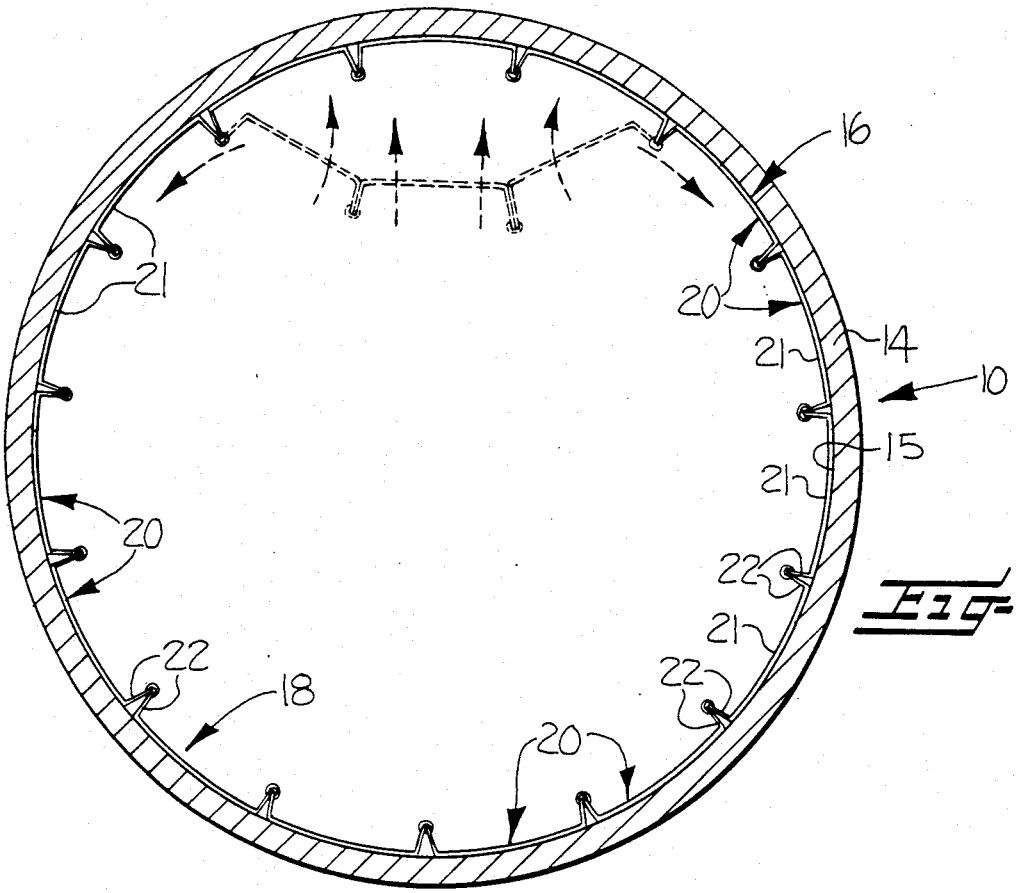
FIG. 3 is a side elevation view of the cylinder dryer in cross-section taken along the line 3—3 in FIG. 2.
Figure 4:
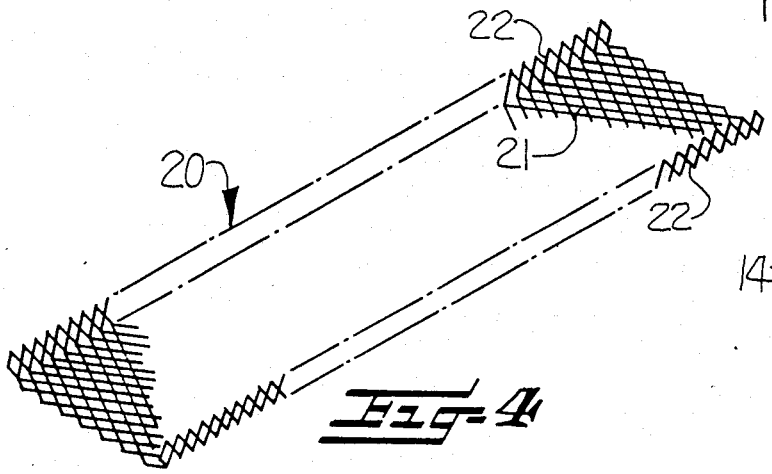
FIG. 4 is a perspective view of a preferred form for a modular agitation element for constructing the agitator.

The preferred modular elements 20 include an open-work member 21 and resilient connecting means 22 which extend in offset relation from the opposed ends of the open-work member 21 (FIG. 4). The modular elements 20 are preferably of unitary construction and may be fabricated from any suitable starting material including stainless steel expanded or perforated metal. Where the modular elements 20 are of unitary construction, the ends of the open-work member 21 may be offset by simply bending the same to provide the resilient connecting means 22. The degree of offset will depend upon the particular material selected, but should be sufficient to maintain the modular elements 20 in secure, spring biased interengagement with other elements in a row (FIG. 3). An included angle in excess of approximately 90 degrees to the open-work member should be sufficient in most applications, and preferably about 95 to 100 degrees in magnitude.

In order to induce and maintain the desired spring biased interengagement, the open-work member 21 is preferably planar (i.e., having opposite flat surfaces) prior to the installation of the modular elements 20 in the dryer cylinder, and yet sufficiently flexible to adapt to the generally arcuate shape of the interior surface 15 of the dryer cylinder 10 upon installation. The open-work member 21 should not be overly flexible, however, and should have sufficient resilience so as to exert forces on the resilient connecting means 22 to maintain the modular elements in spring-biased interengagement with each other. In this regard, thirteen gauge expanded metal, having diamond shaped openings of about 1¾ inches in length, has been found to possess the requisite characteristics from the standpoint of both resilience and flexibility. The preferred expanded metal material is typically sold in widths of four feet and in lengths up to about ten feet. The preferred expanded metal sheets are cut into segments of an appropriate length, and preferably about nineteen inches in length whereupon the resilient connecting means 22 are preferably formed by bending the opposed terminal ends of the segments to provide modular elements 20 having a preferred length of about fifteen to sixteen inches in order to facilitate installation in an existing cylinder dryer at a plant site. In other words, the modular elements 20 should be dimensioned in their maximum lengthwise orientation in relation to the prevailing maximum manhole dimensions of approximately fifteen to sixteen inches. This will facilitate their insertion through the manhole 13 for subsequent placement on the interior surface of the dryer cylinder. In order to minimize waste, the width of the modular elements 20 is preferably equal to the width of the preferred expanded metal sheet material (four feet).

The openings 17 and 117 in the open-work body 18 and 118, whether or not the body is formed of the preferred modular elements 20, are preferably of uniform size and distribution so that variations in the moisture profile of the paper web W across the width of the machine will be minimized. The openings should comprise at least about forty percent of the surface area of the open-work body and preferably about 80% of the area as in the preferred expanded metal sheet material. In addition, the openings are preferably diamond-shaped with one pair of opposed included angles A (FIG. 8), which are preferably less than sixty degrees in magnitude, being acute and smaller than the other pair of opposed included angles B. Moreover, the body 18 or 118 should be oriented so that the apex of one of the acute included angles points in the direction of rotation of the drum while the apex of the second acute angle of the pair A points in the opposite direction. In this manner, the agitator 16 and 116 more effectively induces movement in the condensate layer along the interior surface 15 and 115 of the dryer cylinder, tangential to the periphery of the cylinder, as by channelling the condensate toward a respective apex where it will spill over the material 19 and 119 surrounding the openings 17 and 117 (see FIG. 8) which is particularly important at higher operating speeds. At speeds of approximately 2,000 feet per minute the condensate will move approximately two inches on each side of a five foot diameter cylinder. In a preferred agitator (having 1¾ inch diamonds) the condensate would strike the material surrounding the openings 19 and 119 (FIG. 8) at least twice during each revolution of the dryer cylinder.

The open-work body 18 and 118 is preferably mounted in flush engagement with the interior surface 15 or 115 of the dryer cylinder and with the agitator in direct contact with the condensed steam layer, and preferably in contact with the live steam as well, in order to aid the heat transfer uniformity through the dryer wall 14 and 114 to the paper web W.

The novel modular agitation elements 20 may be easily installed in an existing, operational dryer cylinder. If the modular agitation elements are properly dimensioned as described above, they may be easily inserted through the manhole 13 into the interior of the dryer cylinder 10. Thereafter, the modular agitation elements 20 are arranged in circular end to end abutting relation to each other along the interior surface 15 of the dryer cylinder. As the circle is being formed, the resilient connecting means 22 of adjacent modular agitation elements 20 may be temporarily or permanently loosely wired together (FIG. 5) at selected points or temporarily clamped to maintain the integrity of the assembly while the installation is in progress.

To complete the installation, the last of the modular agitation elements are moved into position as indicated by the broken line schematic in FIG. 3. As the final elements in the particular circular row are pressed into their final position of orientation, the modular agitation elements 20 are forced against each other so that the resulting forces exerted by the offset resilient connecting means 22 will cause all the open-work members 21 to assume an arcuate configuration. The arcuate configuration assumed by the open-work members 21 will in turn create opposing forces at each of their ends, particularly where the open-work members 21 were planar prior to their installation, which cooperate with the resilient connecting means 22 to maintain the elements 20 in spring biased interengagement with each other. The resulting structure is highly stable and obviates the need for auxiliary fasteners, although fasteners may be provided, of course, if additional security against displacement is desired. Any additional circular rows of the modular elements are then installed according to the same procedure until the surface of the dryer cylinder has been lined. In this regard, the agitator 16 and 116 may be of a lesser width than that of the trimmed paper web so that in applications where overdrying of the opposed marginal portions of the web is a problem, these will not be over dried. For example, if the width of the trimmed paper web is approximately 200 inches, the assembled agitator width could be about 175 inches for use in these applications.

As should be apparent from the foregoing discussion, the present invention overcomes the numerous and various shortcomings associated with cylinder dryers equipped with known condensed steam agitation devices. It should be understood that the drawings and specification are presented for purposes of describing the preferred embodiments only, and that they should not be utilized for purposes of unduly limiting the scope of the present invention which scope is defined solely by the appended claims.

That which is claimed is:

1. In a steam heated dryer cylinder of the type used for reducing the moisture content of a formed paper web, as the web contacts the exterior surfaces of the cylinder, and which includes a steam inlet for admitting live steam into the interior of the dryer cylinder, condensate removal means for removing condensed steam from the interior of the dryer cylinder, and condensate agitation means carried by said dryer cylinder and mounted for movement therewith for agitating the condensed steam in the dryer cylinder and wherein said condensate agitation means comprises a generally cylindrical body having spaced apart openings throughout the body so as to provide an open-work body, said open-work body formed of material having opposing flat surfaces, said open-work body overlying portions of the interior surface of the dryer cylinder and having its outer flat surface in flush engagement with the interior surface of the dryer cylinder so that all the material surrounding the openings in the body is in substantially continuous contact with the interior surface of the dryer cylinder.

2. A dryer cylinder according to claim 1, wherein the openings in said body are so configured as to cause the condensed steam to convergingly flow within each opening and along the interior surfaces of the dryer cylinder in a direction which is tangential to the periphery of the dryer cylinder.

3. A dryer cylinder according to claim 1 wherein said body is formed from a plurality of stainless steel sheets having a flat planar construction and wherein said openings comprise at least about forty percent of the surface area of said body.

4. A dryer cylinder according to claim 1, wherein said body overlies substantially all of the interior surface of the dryer cylinder except for the opposed terminal ends thereof so as to avoid over-drying the opposed marginal portions of the papers web as it passes over the exterior surface of the dryer cylinder.

5. A dryer cylinder according to claim 1, wherein the openings in said body are of uniform size and are uniformly distributed over the body.

6. A dryer cylinder according to claim 1, wherein said openings in the body are diamond shaped with one pair of opposed included angles of each diamond being acute and smaller than the other pair of opposed included angles and wherein the body is arranged so that the apex of one of said acute included angles points in the direction of rotation of the drum and the apex of the other of said acute angles points in the opposite direction relative thereto.

7. A dryer cylinder according to claim 1, wherein said body comprises a plurality of modular agitation elements arranged side-by-side in at least one circular row, each of said modular elements comprising an open-work member having integrally formed resilient connecting means extending in offset relation from opposing ends thereof for maintaining said modular elements in spring biased interengagement with each other on the interior surface of the dryer cylinder.

8. In a steam heated dryer cylinder of the type used for reducing the moisture content of a formed paper web, as the web contacts the exterior surfaces of the cylinder, and which includes a steam inlet for admitting live steam into the interior of the dryer cylinder, condensate removal means for removing condensed steam from the interior of the dryer cylinder, and condensate agitation means carried by said dryer cylinder and mounted for movement therewith for agitating the condensed steam in the dryer cylinder and wherein said condensate agitation means comprises a plurality of modular agitation elements arranged in a plurality of side-by-side circular rows, and wherein each of said modular elements comprises an open-work member formed of material having opposing flat surfaces and integrally formed resilient connecting means extending in offset relating from the opposing ends thereof for maintaining said modular elements in spring biased interengagement with each other.

9. A dryer cylinder according to claim 8, wherein the openings in said open-work members are so configured as to cause the condensed steam to convergingly flow within each opening and along the interior surfaces of the dryer cylinder in a direction which is tangential to the periphery of the dryer cylinder.

10. A dryer cylinder according to claim 8 wherein each of said modular elements is formed from a stainless steel sheet having a flat planar construction and wherein the openings in said elements comprise at least about forty percent of the surface area of said elements.

11. A dryer cylinder according to claim 10 wherein the openings in said open-work members are of uniform size and are uniformly distributed over the open-work members.

12. A dryer cylinder according to claim 8 wherein said open-work members overlie portions of the interior surface of the dryer cylinder with the material surrounding the openings in said open-work members being in substantially continuous contact with the interior surface of the dryer cylinder.

13. A dryer cylinder according to claim 8, wherein the openings in said open-work members are diamond shaped with one pair of opposed included angles of each diamond being acute and smaller than the other pair of opposed included angles and wherein said modular agitation elements are arranged so that the apex of one of said acute included angles points in the direction of rotation of the drum and the apex of the other of said acute angles points in the opposite direction relative thereto.

14. A dryer cylinder according to claim 13 wherein each of said acute included angles is less than sixty degrees.

15. A method for installing a condensate agitator in a steam-heated dryer cylinder of the type used for reducing the moisture content of a formed paper web as the web contacts the exterior surfaces of the dryer cylinder and which is characterized by the ease of installation and the elimination of any requirement for independent fastener means for maintaining the agitator in position of the interior surface of the dryer comprising the steps of providing a plurality of modular agitation elements, each of which comprises a substantially planar open-work member formed of material having opposing flat surfaces and integrally formed resilient connecting means extending in offset relation from the opposing ends thereof, positioning a plurality of said elements over at least a substantial portion of the interior surface of said dryer cylinder in circular end to end abutting relation with the resilient connecting means of adjacent abutting ends of said agitation elements being positioned in resiliently biased relation to each other so as to induce an arcuate configuration in each of said open-work members substantially corresponding to the interior surface of said dryer cylinder and to cause the circular arrangement of agitation elements to resiliently engage the interior surface of said dryer cylinder so as to be self-supporting thereon.

* * * * *

UNITED STATES PATENT AND TRADEMARK OFFICE

CERTIFICATE OF CORRECTION

PATENT NO. : 4,674,196

DATED : June 23, 1987

INVENTOR(S) : John A. Means

It is certified that error appears in the above–identified patent and that said Letters Patent are hereby corrected as shown below:

Column 5, Line 5, delete "opposite" and insert --opposing--

Signed and Sealed this

Fifth Day of January, 1988

*Attest:*

DONALD J. QUIGG

*Attesting Officer*

*Commissioner of Patents and Trademarks*